US005315926A

United States Patent [19]

Kanamaru et al.

[11] Patent Number: 5,315,926

[45] Date of Patent: May 31, 1994

[54] HIGH EFFICIENCY, SWASH PLATE MECHANICAL PRESS

[75] Inventors: Hisanobu Kanamaru; Kouji Harada, both of Katsuta, Japan

[73] Assignee: Hitachi, Ltd., Japan

[21] Appl. No.: 101,109

[22] Filed: Aug. 3, 1993

Related U.S. Application Data

[63] Continuation of Ser. No. 882,869, May 14, 1992, abandoned.

[30] Foreign Application Priority Data

May 14, 1991 [JP] Japan ..... 3-107948

[51] Int. Cl.[5] ..... B30B 1/26

[52] U.S. Cl. ..... 100/218; 72/452; 74/60; 83/628; 100/264; 100/280; 100/292

[58] Field of Search ..... 100/218, 264, 280, 281, 100/291, 292; 72/67, 406, 442, 452; 83/602, 627, 628; 74/60

[56] References Cited

U.S. PATENT DOCUMENTS

| | | | |
|---|---|---|---|
| 3,673,951 | 7/1972 | Romer | 100/280 X |
| 3,991,681 | 11/1976 | Antosiak | 100/292 X |
| 4,776,259 | 10/1988 | Takai | 74/60 X |
| 4,784,045 | 11/1988 | Terauchi | 74/60 X |
| 4,894,045 | 1/1990 | Kanamura et al. . | |
| 4,982,651 | 1/1991 | Kanamura et al. . | |

FOREIGN PATENT DOCUMENTS

| | | | |
|---|---|---|---|
| 2111988 | 11/1971 | Fed. Rep. of Germany | 100/291 |
| 60-210398 | 10/1985 | Japan | 100/280 |
| 246291 | 10/1969 | U.S.S.R. | 72/452 |
| 339431 | 7/1972 | U.S.S.R. | 72/452 |

*Primary Examiner*—Stephen F. Gerrity
*Attorney, Agent, or Firm*—Evenson, McKeown, Edwards & Lenahan

[57] ABSTRACT

A mechanical press includes a slider which is reciprocated, through connecting rods, by an oscillating plate oscillating around a driving shaft to obtain a press load. The press further includes a swash plate rotatable with the driving shaft. The oscillating plate oscillates in accordance with the rotation of the swash plate. A plurality of lock pins are concentrically disposed in parallel with the driving shaft on a side of the oscillating plate opposite to the swash plate. Each of the lock pins has a spherical head housed in the oscillating plate so as to make the pins rotatable and axial movable. A slider guide supports the pins and the slider.

11 Claims, 6 Drawing Sheets

HIGH EFFICIENCY, SWASH PLATE MECHANICAL PRESS

This is a continuation of application Ser. No. 07/882,869, filed May 14, 1992 now abandoned.

BACKGROUND OF THE INVENTION

The present invention relates to a mechanical press, and particularly to a mechanical press suitable for forming parts by cold extrusion, punching and drawing with high precision.

A mechanical press having a reciprocating slider connected, through rods, to one end of an oscillating plate oscillating around a driving shaft is disclosed in, for example, Japanese Patent Unexamined Publication No. 60-210398.

Since the oscillating plate is carried by a movable shaft only, such a swash plate type mechanical press has a long span between an axis of the movable shaft and the force point subjected to a work load during press. A rigidity of the oscillating plate of the mechanical press thus becomes low, and then work parts with high precision cannot be obtained.

In addition, a cross spider type universal joint serves not only as a joint, but also as a lock pin mechanism for preventing the oscillating plate from rotating together with the driving shaft. Therefore, the mechanical press has a low rigidity and durability, particularly, to a larger driving torque generated during the operation of the press. Further, since the universal joint itself is a nonuniform joint, rotation cannot be stably transmitted, and then it is difficult to produce products with high precision.

SUMMARY OF THE INVENTION

It is an object of the present invention to provide a mechanical press having a high rigidity and a high precision.

It is another object of the present invention to provide a mechanical press comprising a small driving mechanism having high mechanical efficiency.

In order to achieve the objects, the present invention provides a mechanical press comprising a driving shaft, a swash plate rotatable with the driving shaft, a plate connected to one side of the swash plate, the plate oscillating around the driving shaft in accordance with a rotation of the swash plate, a slider, a rod for connecting the oscillating plate with the slider, the rod reciprocating the slider in accordance with oscillation of the oscillating plate so as to generate a press load, a plurality of pins disposed at the other side of the swash plate and located concentrically in parallel to the driving shaft, each having a spherical head end which is housed within the oscillating plate, thereby making the pins axial movable and rotatable, and a slider guide carrying the pins and the slider.

Accordingly, the work load acting on the slider can be vertically received by the swash plate through connecting rods and the oscillating plate. The plurality of lock pins thus linearly slide, and the spherical heads thereof are held concentrically with the oscillating plate so that the oscillation center is kept in a floating state.

DETAILED DESCRIPTION OF PREFERRED EMBODIMENTS

Figure 1:
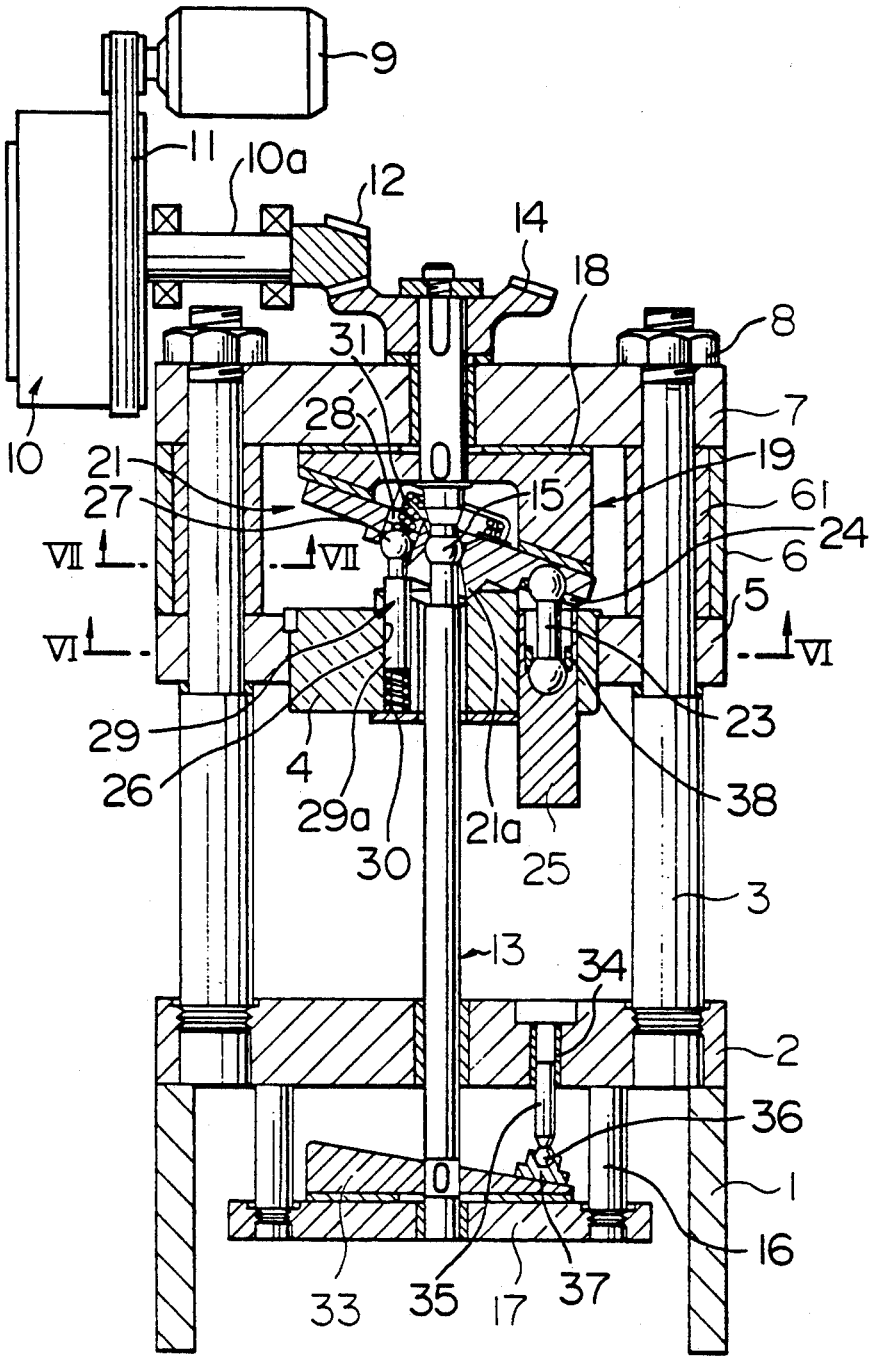
FIG. 1 is a partially longitudinally sectional view of a mechanical press in accordance with an embodiment of the present invention.

Referring to FIG. 1, a press machine includes a bolster 2 fixed on a frame 1. Tie rod 3 is planted vertically at each of four corners of the bolster 2. A middle plate 5, uprights 6, and a crown 7 are disposed in order along an intermediate portion of the tie rods 3. Each of the tie rods 3 has a step portion provided at an intermediate portion thereof so that these elements 5, 6, and 7 are securely and stably tightened by tightening nuts 8. The middle plate 5 incorporates a slider guide 4.

A motor 9 is mounted on the crown 7 by fixing means (not shown), and a rotational shaft 10*a* of a fly-wheel clutch 10 is born on the crown 7. The motor 9 and the fly-wheel clutch 10 are connected by a belt 11. A pinion 12 jointed to an end of the rotational shaft 10*a* is engageable with a bevel gear 14 jointed to an input side end of a driving shaft 13 placed at a center of the press machine. The driving shaft 13 has a sphere 15 serving as a center of oscillation and is rotatably supported, through metal bearing, by the crown 7, the middle plate 5, the bolster 2 and a knockout plate 17 held by the bolster 2 through rods 16.

Figure 7:
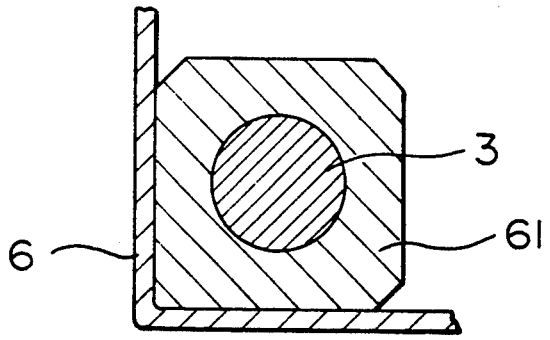
FIG. 7 is a sectional view taken along the line VII—VII in FIG. 1.
Figure 8:
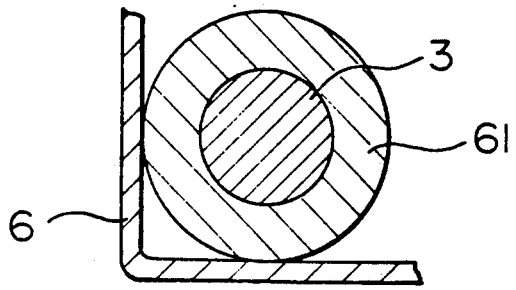
FIG. 8 is a sectional view of a tie rod in another embodiment of the invention taken the same as in FIG. 7.

The tie rod 3 is surrounded at between the middle plate 5 and the crown 7 by a square or circular pipe 61, as shown in FIG. 7 or 8, so that the rigidity of the tie rod 3 between the middle plate 5 and the crown 7 is increased, thereby improving the precision of a motion converting mechanism.

Figure 2:
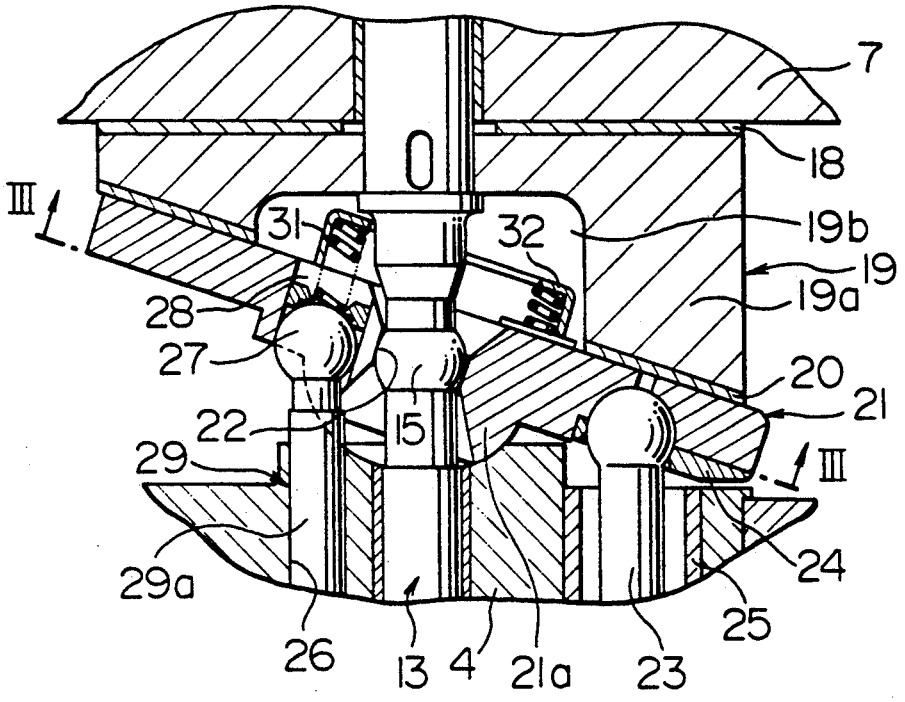
FIG. 2 is an enlarged fragmentary view of the mechanical press shown in FIG. 1.
Figure 4:
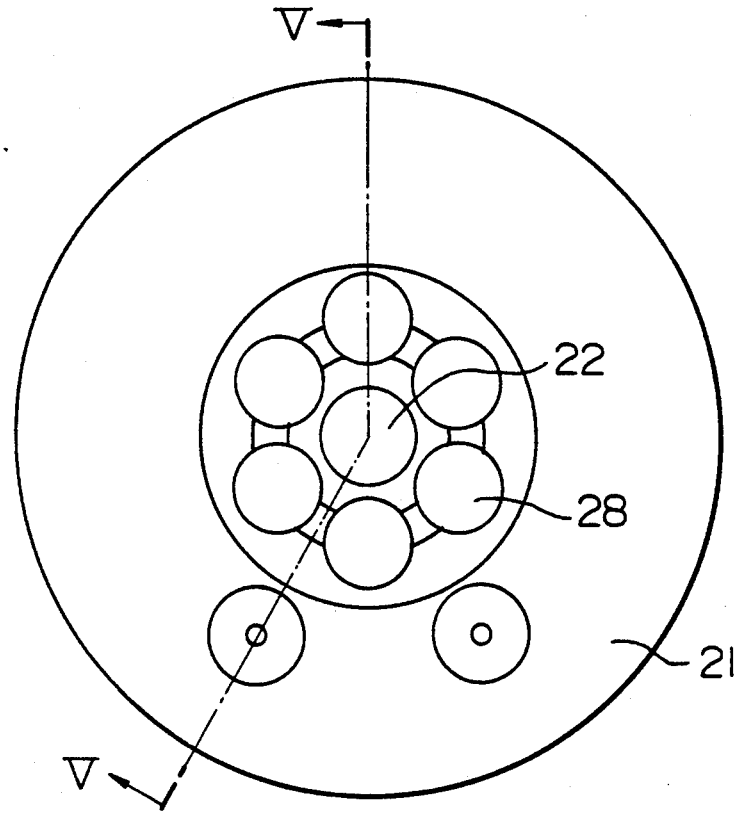
FIG. 4 is a bottom view of an oscillating plate shown in FIG. 2.
Figure 5:
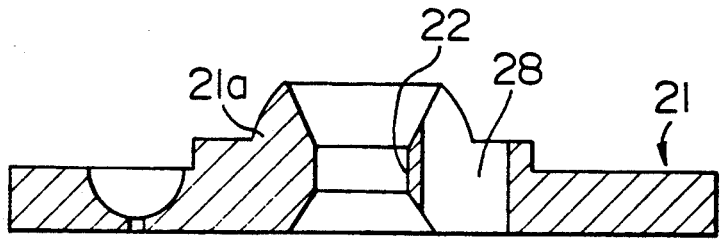
FIG. 5 is a sectional view taken along the line V—V in FIG. 4.

A swash plate 19 is fitted onto a portion of the driving shaft 13 between the crown 7 and the middle plate 5. One side of the swash plate 19, as shown in FIG. 2 in more detail, is slidably abutted against the crown 7 through a metal bearing sheet 18. The swash plate 19 is slidably abutted at the other side thereof with an oscillating plate 21 through a metal bearing sheet 20. As shown in FIGS. 4 and 5, the oscillating plate 21 has a semi-spherical surface portion 21*a* integrally formed at a center thereof which projects and has an axial through hole 22. The semi-spherical surface portion 21*a* rotatably faces the slider guide 4, and preferably is put into spherical contact therewith. The sphere 15 is rotatably supported by the hole 22 so as to prevent the axial movement of the oscillating plate 21.

Figure 3:
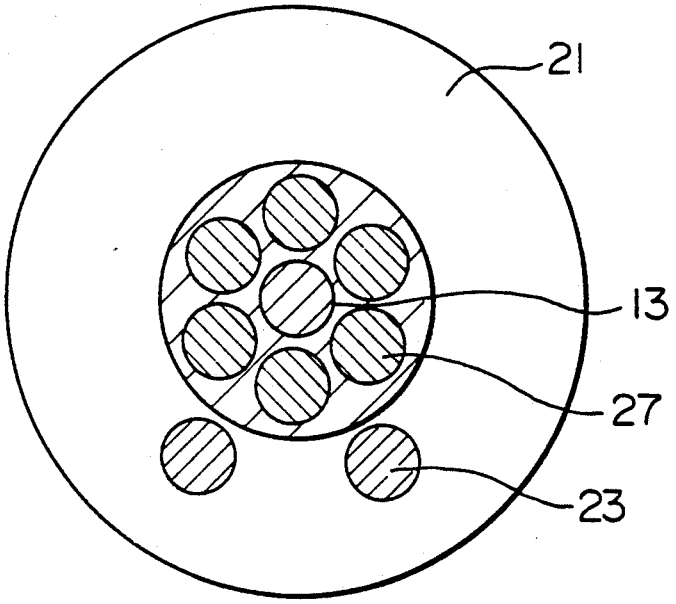
FIG. 3 is a sectional view taken along the line III—III in FIG. 2.

A connecting rod 23 having spheres at both ends is rotatably supported by the oscillating plate 21 through a support plate 24 and is disposed at one end thereof near the perpendicular surface of the cylindrical portion 19*a* of the swash plate 19, as shown in FIGS. 2 and 3. The other end of the connecting rod 23 is rotatably held in the slider 25 supported by the slider guide 4 through a cap 38.

Figure 6:
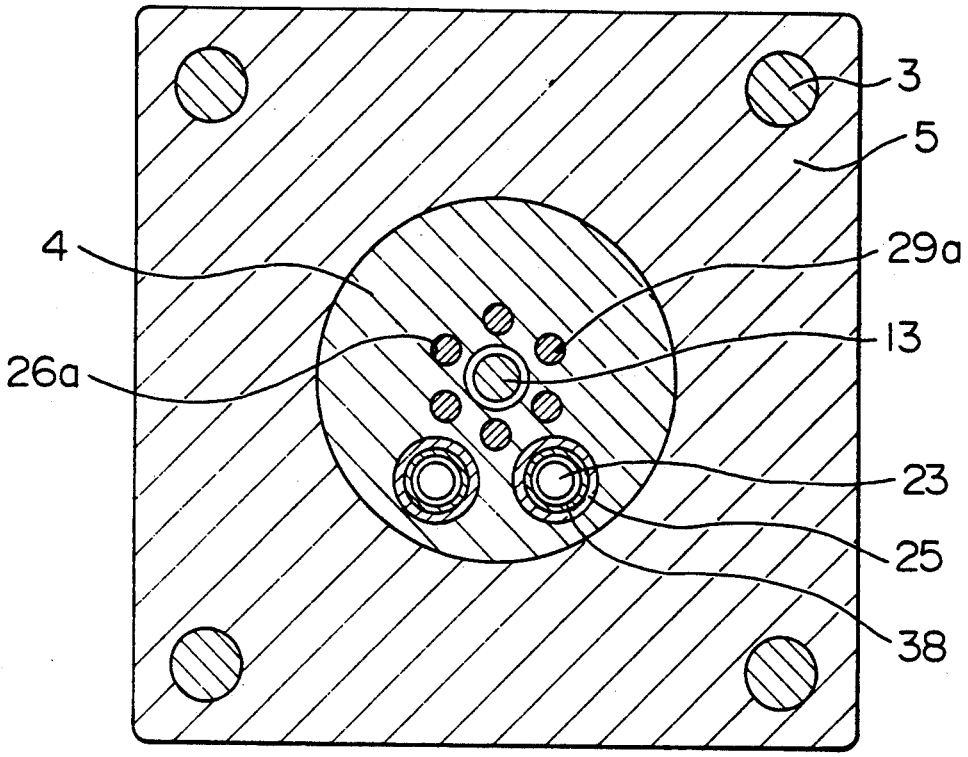
FIG. 6 is a sectional view taken along the line VI—VI in FIG. 1.

The slider guide 4 at a center of the middle plate 5 has six cylindrical through holes 26 disposed concentrically and spaced equiangularly, as shown in FIG. 6. A cylindrical end portion 29*a* of a locking pin 29 is slidably held by the respective cylindrical holes 26*a* through a compression coil spring 30. The lock pin 29 has at the other end a spherical head 27 which is rotatably engaged with a spherical head hole 28 of the oscillating plate 21.

A compression coil spring 31 is held by a cap-like spring pressure member 32 for urging the respective spherical head 27. The compression force of the spring 30 is substantially equal to that of the compression spring 31, so that the lock pin 29 is constantly supported in a floating state. The spring pressure member 32 is disposed in a recess portion 19*b* provided in the swash plate 19.

A description is now made of an ejector or a knock-out mechanism. A swash plate 33 is mounted on the knockout plate 17, and connected to the driving shaft 13. A slider 35 is slidably disposed in the bolster 2 through a bearing 34. A spherical head 36 of the slider 35 is rollingly housed by a slipper 37. The slipper 37 slides on an inclined surface of the swash plate 34 so as to move the slider 35 axially.

An operation of the press machine thus constructed will be described hereinunder.

When the motor 9 is driven, the rotational force is transmitted to the fly-wheel clutch 10 through the belt 11, and an energy of such rotational force is held by the fly-wheel clutch 10. The rotational force selectively transmitted by the clutch 10 to rotate the driving shaft 13 through the pinion 12 and the bevel gear 14. The swash plate 19 is thus rotated together with the driving shaft 13, and then the oscillating plate 21 is oscillated, while the rotation thereof is inhibited by the lock pins 29. Since the compression forces of the compression springs 30 and 31 are constantly balanced, the lock pins 29 are axially moved freely through the hole 26. Since the spherical heads 27 of the lock pins 29 are thus substantially constantly placed on a concentric locus, the connecting rods 23 securely transmit vertical movements to the sliders 25 to perform a press operation without horizontal movement.

The lock mechanism of the oscillating plate 21 uniformly transmits the rotational driving force to the oscillating plate 21 and thus produces no vibration, thereby causing low noise and high mechanical efficiency. In addition, since a plurality of lock pins 29 are disposed radial inwards from the sliders 25 to which small driving torques are applied, thin pins may be used as the lock pins. Further, since the rotation preventing force can be distributed to each of the pins, the press machine has high reliability of mechanical strength even if it is small. The structure in which the entire load during the operation of the press is received by the swash plate 19 increases the rigidity and mechanical efficiency of the machine.

In the above embodiment, since the tensile force generated when the slider 25 is separated from a work (not shown) is received by the semi-spherical surface portion 21*a* provided at the center of the oscillating plate 21, the resistance to the tensile force is high.

In addition, since the swash plate 19 has a cylindrical structure in which the spring pressure 32 is disposed in the recess portion 19*b*, the dead space is effectively employed, and the axial length of the apparatus is decreased, thereby contributing to a decrease in the size thereof.

Further, since the slide guide 4 is separate from the middle plate 5, the slider guide 4 can be replaced by another one as occasion demands, thereby easily standardizing the apparatus.

Figure 9:
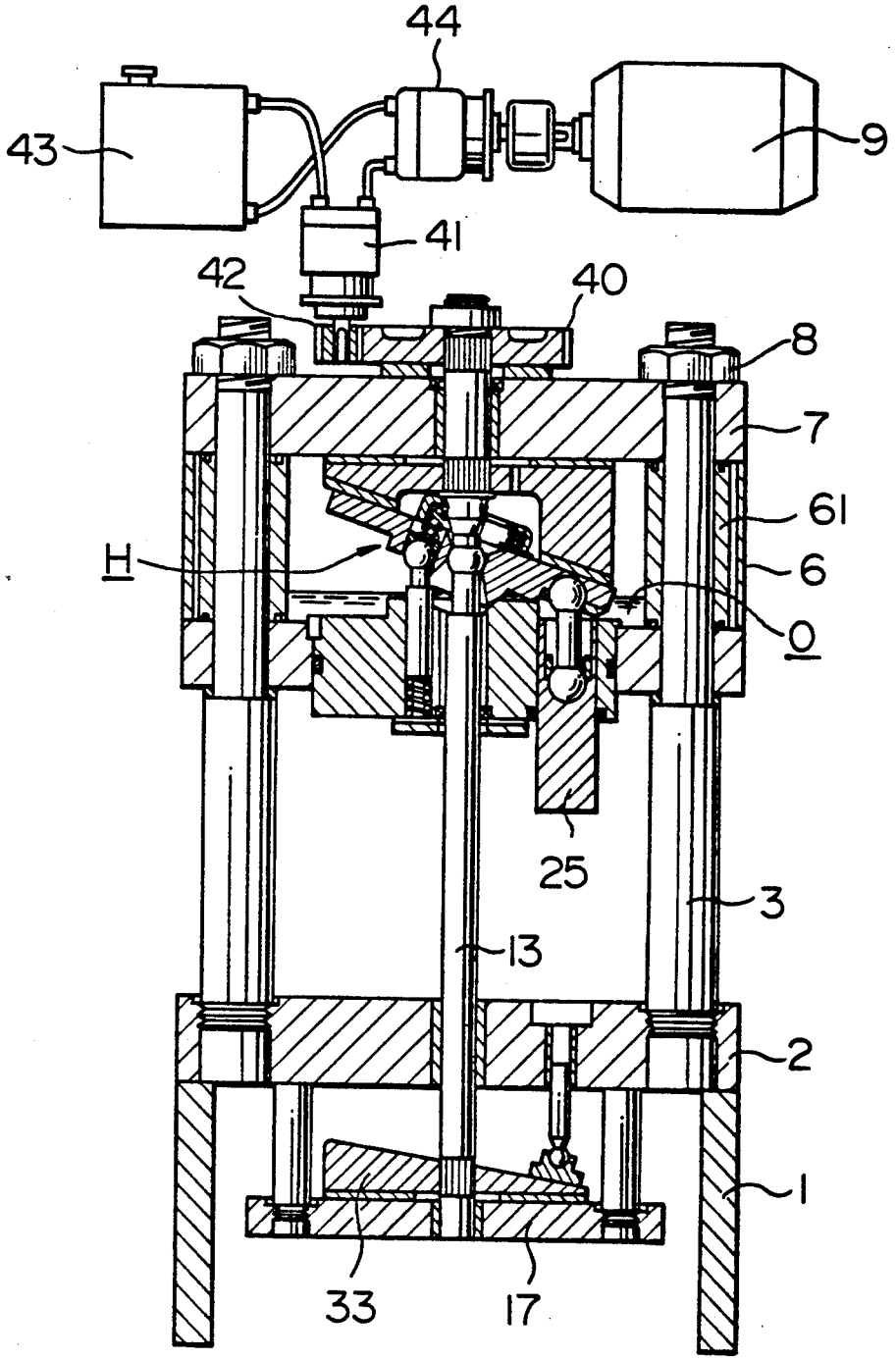
FIG. 9 is a partially longitudinally sectional view of a mechanical press in accordance with another embodiment.

FIG. 9 shows another embodiment in which a driving source is modified. An input gear 40 is secured to a driving shaft 13, which engages with an output gear 42 of a hydraulic motor 41. The hydraulic motor 41 is connected, through an oil tank 43, to a hydraulic pump 44 which is driven by an electric motor 9. This embodiment is characterized in that an output converting mechanism H is within lubricating oil O. The lubricating oil O is of course contained in a sealed structure. According to this embodiment, the durability of the parts of the output converting mechanism is improved and machine sound is absorbed.

Figure 10:
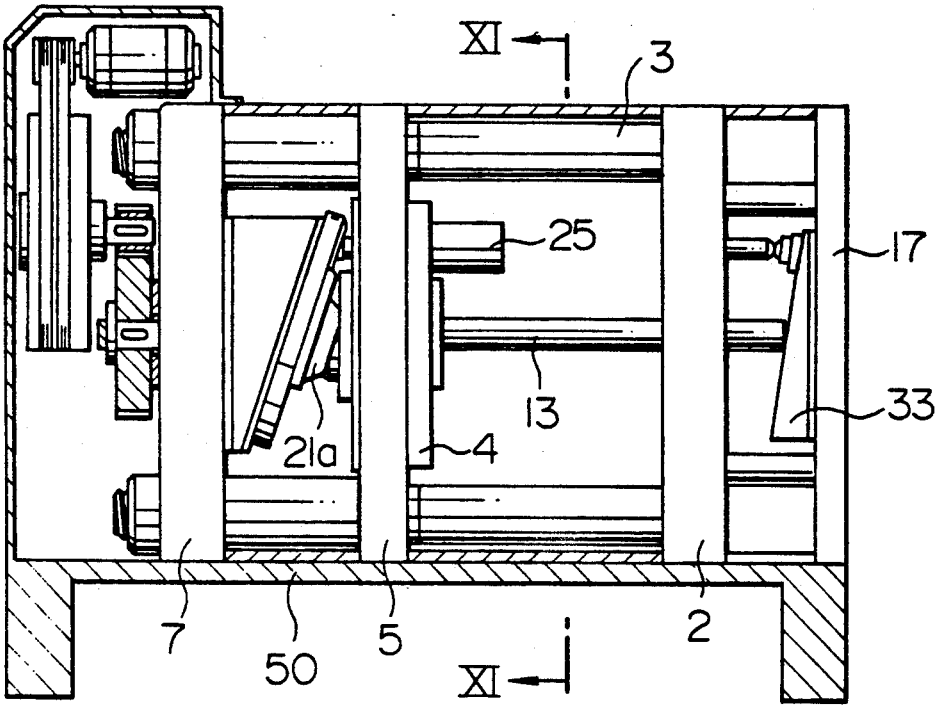
FIG. 10 is a partially longitudinally sectional view of a horizontal press in accordance with a further embodiment.
Figure 11:
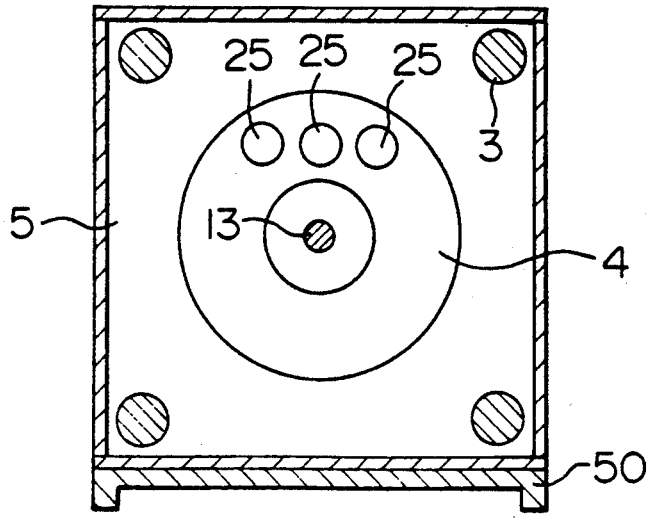
FIG. 11 is a sectional view taken along the line XI—XI in FIG. 10.

FIGS. 10 and 11 show a press machine according to a further embodiment of the invention, which is horizontally mounted on an upper side of a box-like base 50. Although this embodiment is fundamentally the same as the first embodiment, this embodiment is different from the first embodiment in the point that three sliders 25 are provided parallel.

In the present invention, since the work load applied to the slider is received by the swash plate, a small press machine having high rigidity and comprising a driving mechanism having high mechanical efficiency can be obtained.

What is claimed is:

1. A mechanical press, comprising spaced supporting portions, a driving shaft operatively disposed between the supporting portions so as to be rotatably supported by said supporting portions, a swash plate coaxially operatively fixed to a part of said driving shaft between the spaced supporting portions for rotation with said driving shaft, a slider, a slider guide connected with at least one of the supporting portions and operatively carrying said slider, and an oscillating plate swingable about said driving shaft, and said swash plate swinging said oscillating plate as said swash plate rotates, said oscillating plate having an integral, semispherical central projecting portion slidably abutted onto a complementary surface of said slider guide, whereby said oscillating plate operatively cooperates with said swash plate for converting a rotational movement of said driving shaft and said swash plate to a reciprocating movement of said slide so as to obtain a pressing force.

2. A mechanical press according to claim 1, wherein a bearing sheet is arranged in slidably abutting relationship between said swash plate and one of said supporting parts.

3. A mechanical press according to claim 2, wherein said oscillating plate is operatively arranged with respect to said swash plate to provide sliding contact.

4. A mechanical press according to claim 1, wherein said oscillating plate is swingably held by said driving shaft.

5. A mechanical press comprising:

a driving shaft;

a swash plate rotatable with said driving shaft;

an oscillating plate abutting at a first side thereof said swash plate for oscillating around said driving shaft with a rotation of said swash plate;

a slider;

a connecting rod having one end for connecting said oscillating plate with said slider, said rod reciprocating said slider in accordance with oscillation of said oscillating plate so as to generate a press load;

a plurality of pins disposed at a second side of said oscillating plate and located concentrically to and in parallel to said driving shaft, each of the pins having a spherical head end which is housed within said oscillating plate, thereby making said pins axial movable and rotatable; and a slider guide operatively carrying said pins and said slider.

6. A mechanical press according to claim 5, wherein at least three pins are located radial inward from said connecting rod and equiangularly.

7. A mechanical press according to claim 5, wherein said oscillating plate has a spherical surface portion formed at a center thereof and supported by said slider guide.

8. A mechanical press according to claim 7, wherein said spherical surface portion is integrally formed in said oscillating plate and wherein said slider guide includes a spherical surface portion which is abutted against said spherical surface portion of said oscillating plate.

9. A mechanical press according to claim 5, wherein said connecting rod has a spherical head end at a second end thereof, said swash plate has a cylindrical portion, and said connecting rod is rotatably held by a support plate at the second side of said oscillating plate, and said connecting rod is housed at said second end thereof in said slider.

10. A mechanical press comprising:

a driving shaft extending through a bolster, through a middle plate above the bolster and through a crown disposed above the middle plate;

a swash plate rotatable arranged with said driving shaft;

an oscillating plate operatively connected to one side of said swash plate for oscillating with a rotation of said swash plate;

a slider;

a connecting rod for operatively connecting said oscillating plate with said slider, said rod reciprocating said slider in accordance with oscillation of said oscillating plate so as to generate a press load;

a plurality of pins disposed at a second side of said swash plate and located concentrically to and in parallel to said driving shaft, each of the pins having a spherical head end which is housed within said oscillating plate, thereby making said pins axial movable and rotatable; and a slider guide operatively carrying said pins and said slider.

11. A mechanical press according to claim 10, wherein said slider is exchangeable mounted in said middle plate.

* * * * *